United States Patent [19]

Hinterreiter

[11] 4,130,293

[45] Dec. 19, 1978

[54] SKI POLE HANDLE OF SYNTHETIC RESIN

[76] Inventor: Ignaz Hinterreiter, Ramsauerstrasse 119, Linz, Austria, A-4020

[21] Appl. No.: 817,968

[22] Filed: Jul. 22, 1977

[30] Foreign Application Priority Data

Jul. 26, 1976 [AT] Austria ..... 5464/76

[51] Int. Cl.[2] ..... A63C 11/22

[52] U.S. Cl. ..... 280/11.37 H

[58] Field of Search ..... 280/11.37 H, 11.37 B, 280/11.37 E, 11.37 D, 11.37 R

[56] References Cited

U.S. PATENT DOCUMENTS

| | | | |
|---|---|---|---|
| 3,378,273 | 4/1968 | Lewis et al. | 280/11.37 H |
| 4,005,872 | 2/1977 | Rischert | 280/11.37 H |

*Primary Examiner*—Joseph F. Peters, Jr.
*Assistant Examiner*—Gene A. Church
*Attorney, Agent, or Firm*—Kurt Kelman

[57] ABSTRACT

The invention relates to a ski pole handle of synthetic resin, which has a laterally open recess in its head portion for receiving the flatly superposed ends of a strap forming a support loop, the strap ends being fastened in the head portion by means of bolts passing through apertures in the strap ends. Known ski pole handles of this type usually consist of several individual parts which must be assembled with the use of screws and hinges. These known ski pole handles are expensive to manufacture, time-consuming in assembly and, in use, jerky loads often lead to injuries of the user as well as damage to the handle.

3 Claims, 2 Drawing Figures

SKI POLE HANDLE OF SYNTHETIC RESIN

It is the object of the invention to eliminate the disadvantages of these known ski pole handles and to provide a safety handle which will free one end of the strap when the loop is subjected to tensile loads exceeding undetermined values.

In a ski pole handle of the first indicated type, this is accomplished according to the invention by a hinged locking cover for closing the recess, which is connected with the handle body by a flexible web and is made integral with the handle body, and which holds the upper strap end down in the position wherein it is mounted on the bolt.

The structure according to the invention substantially simplifies the positioning of the strap ends in the handle because the fastening zones are readily accessible when the hinged cover is open. The hinged cover is connected to the rest of the handle by the web so that it cannot be lost and is manufactured integrally together with the rest of the handle. This avoids a difficult and expensive assembly with the use of hinges, screws, bolts, etc. The possible direction of movement and the position of the hinged cover in relation to the recess is determined by the flexible web so that the hinged cover is simply moved into the recess by bending the web until it rests therein. Since no metallic parts need be used at the exterior of the handle, danger of injury is considerably reduced.

The ski pole handle of the invention also operates as a safety handle since, upon the occurrence of tensile loads on the loop which exceed predetermined values, the hinged cover snaps open and thereby frees the superposed end of the strap. This eliminates injuries which may occur, for example, when a skier who has pulled the pole loop over his wrist gets caught with the pole in ice, on trees or on some projections on the ski lift.

A further embodiment of the invention provides a transverse web integral with the head portion and dividing the recess into receiving chambers for the upper and lower strap end. The pin is supported in the transverse web so that the forces are distributed and transmitted from the loop to the pole handle.

Figure 1:
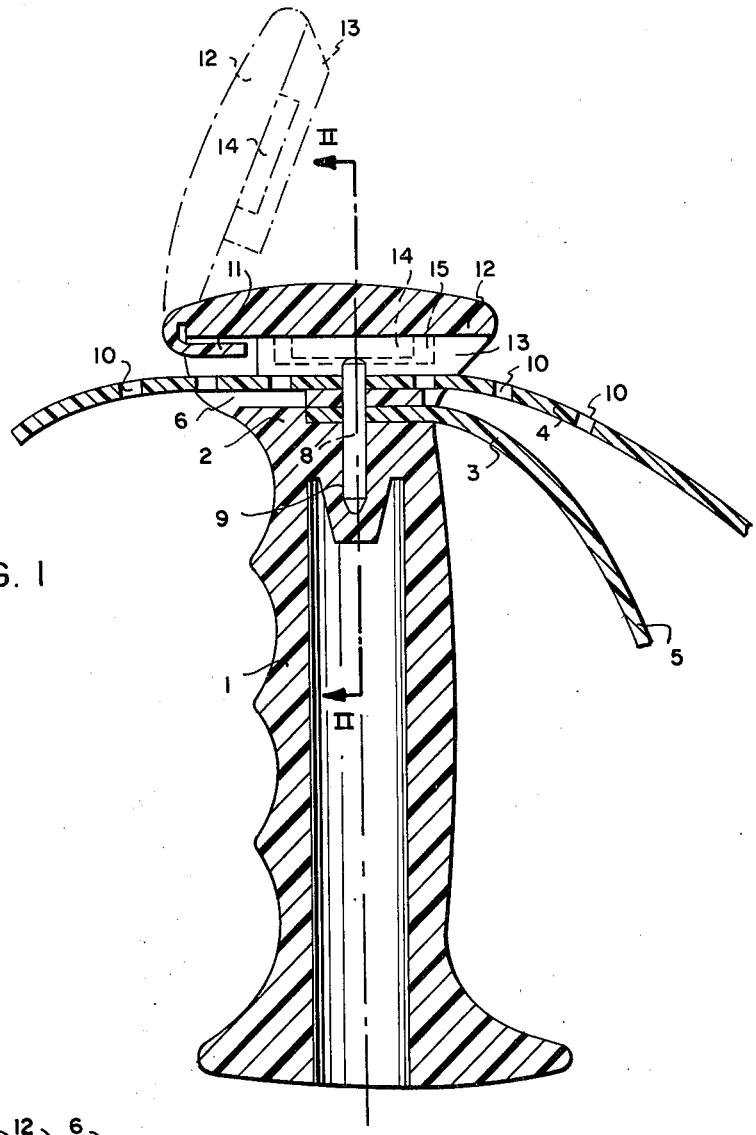
Figure 2:
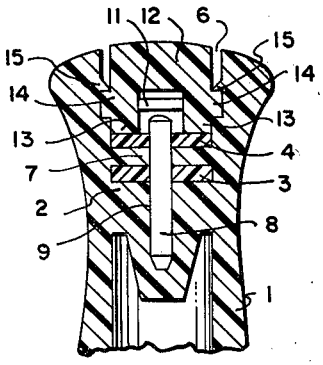

The invention is illustrated in the drawing by way of example in connection with an embodiment thereof. In the drawing, FIGS. 1 and 2 show a ski pole handle according to the invention in longitudinal section and in a section according to line II—II of FIG. 1.

A ski pole handle 1 made of synthetic resin and conforming to the shape of a hand has in its head portion 2 a device for holding the two ends 3, 4 of a strap forming a loop 5. For this holding device, head portion 2 is provided with an elongated recess 6 which is open on top and respective end thereof, the recess being bridged over at two locations only. One of the bridges consists of a transverse web 7 which sub-divides the recess into receiving chambers for the lower strap end 3 to be fastened rigidly and the upper strap end 4 fastened detachably and longitudinally adjustably. The transverse web 7 has an aperture through which extends a pin, bolt or the like 8 passing through strap end 3 into blind bore 9. The upper end of this pin projects beyond web 7 so that the strap end 4 may be attached to this end with one of its attachment holes 10. When the loop is shortened, the free end of strap portion 4 projects out of recess 6 at the end opposite the end of the recess from which the loop projects.

It has already been mentioned that recess 6 is bridged at two locations. The second bridging lies at the end of the recess facing away from the loop, this bridge consisting of a flexible web 11 which is integrally formed with the handle and whose wall thickness is selected sufficiently thin at least outside the recess to enable it to be bent. A cover 12 is hingedly connected by this web with handle 1. Hinged cover 12 is molded, for example, in the position relative to the remainder of handle 1 indicated in chain-dotted lines in FIG. 1.

The hinged cover has two parallel pressure bars 13 each of which has laterally protruding locking projections 14. After loop ends 3, 4 are inserted, hinged cover 12 is pressed out of the position indicated in chain-dotted lines into the position of use indicated in full lines by bending web 11, locking projections 14 subtending cooperating bosses 15 in the side walls of recess 6 so that the cover is fixed in the illustrated position of use, pressure bars 13 pressing the end 4 of the strap against web 7.

The force required for opening hinged cover 12 is predetermined by cooperating projections 14 and bosses 15. When loop 5 is pulled upwardly, strap part 4 produces a moment in the direction of pivoting hinged cover 12 upwardly. This moment, aside from the effective absolute force, increases proportionally with the component of force operating away from the pole in the direction of elongation of the pole. When the moment exceeds the predetermined safety value, the projections 14 and bosses 15 are disengaged, hinged cover 12 pivots into the position indicated in chain-dotted lines and strap end 4 is disengaged from bolt 8 so that it becomes free and loop 5 is opened.

I claim:

1. A ski pole handle, comprising a head portion including two lateral walls defining therebetween a recess open on top and at respective ends thereof, a cover movable between a closed and open position into and out of the recess through the open top between the two lateral walls, and a flexible web integrally and hingedly connecting the cover to the lateral walls of the head portion at one of the recess ends whereby the web bridges the one open recess end, the head portion, the cover and the web forming an integral unit of synthetic resin, a bolt in the head portion and projecting into the recess, a strap having two ends and formed into a loop projecting from the end of the recess opposite the one end, the strap ends defining apertures and being superposed in the recess, the bolt passing through registering ones of the apertures in the strap ends whereby the strap ends are fastened to the bolt, and the cover having portions pressing against an upper one of the superposed strap ends in the closed position thereof while permitting detachment of the upper strap end from the bolt in the open position.

2. The ski pole handle of claim 1, wherein the cover portions have laterally protruding locking projections and the lateral walls have inwardly protruding bosses, the projections subtending the bosses in the closed position for locking the cover in this position.

3. The ski pole handle of claim 1, further comprising a transverse web integral with the two lateral walls and bridging the open recess between the ends thereof, the transverse web dividing the open recess into respective chambers for receiving the superposed strap ends.

* * * * *